US006065504A

United States Patent [19]

Sidore

[11] Patent Number: 6,065,504

[45] Date of Patent: May 23, 2000

[54] PORTABLE LOOM

[76] Inventor: Micala Sidore, 19C Hawley St., Northampton, Mass. 01060

[21] Appl. No.: 09/240,747

[22] Filed: Jan. 29, 1999

[51] Int. Cl.[7] ..... D03D 29/00

[52] U.S. Cl. ..... 139/29; 28/151

[58] Field of Search ..... 139/29, 33, 34; 28/151, 152

[56] References Cited

U.S. PATENT DOCUMENTS

| | | | |
|---|---|---|---|
| 2,607,979 | 8/1952 | Throop | 28/15 |
| 3,867,965 | 2/1975 | Hanson | 139/29 |
| 3,996,969 | 12/1976 | McCullough et al. | 139/34 |
| 4,046,171 | 9/1977 | Wilson | 139/29 |
| 4,832,085 | 5/1989 | Northrup | 139/34 |

*Primary Examiner*—Andy Falik

[57] ABSTRACT

A portable loom comprises a header, a spaced bottom frame member and hollow side supports extending removably between the header and the bottom frame. The length of the side supports may be adjusted so that the tension of a warp extending between the header and the bottom frame member can be adjusted. Preferably, the length is adjusted by externally-threaded rods inserted axially within respective side supports and an internally threaded abutment member seated upon on end of the respective side supports. Dowels received within apertures within the frame are provided so that string heddles can be formed.

3 Claims, 10 Drawing Sheets

PORTABLE LOOM

FIELD OF THE INVENTION

The present invention relates to a portable loom which can be transported and yet can be setup rather easily.

BACKGROUND OF THE INVENTION

Weaving is, of course, one of the oldest arts and portable looms have been available for centuries. From a recent resurgence in the interest of weaving, there has arisen a need for a portable loom which can be transported easily and yet can be assembled or disassembled rather simply. In this way, a weaver can bring the portable loom to a class or to a demonstration or exhibit without the need for more complex looms and their attendant transportation problems.

Also, the portable loom is of such a design that a weaving or tapestry in progress on the loom can be folded with the loom in a disassembled condition for transport.

To these ends, a portable loom comprises a header and a bottom frame member spaced in parallel relation thereto. Side supports extend removably between the header and the bottom frame member to form a quadrilateral frame. The side supports each include means for adjusting their length to vary the tension of a warp which may be extended between the header and the bottom frame member.

The adjusting means for the side supports preferably include externally-threaded rods adapted to be inserted axially within the respective side supports. An internally-threaded abutment member is provided to seat upon one end of the respective side support.

Means are also provided for making string heddles, and the heddle-making means include dowels which can be received with respective apertures formed within the quadrilateral frame to enable string heddles to be formed therebetween. The portable loom also includes a stable heddle bar and a pendant heddle bar depending from the stable heddle bar to receive the string heddles for weaving.

By these structures, a portable loom is provided which can be assembled or disassembled rather simply; and when assembled string heddles can be formed rather easily so that the loom can be made operational to weave demonstration projects and the like without the need for transporting more complex looms.

These and other objects, features and advantages of the present invention will become more apparent upon review of the detailed descriptions made below of the preferred embodiment; such descriptions being made in connection with the following drawing figures.

DETAIL DESCRIPTION OF PREFERRED EMBODIMENT

Figure 1:
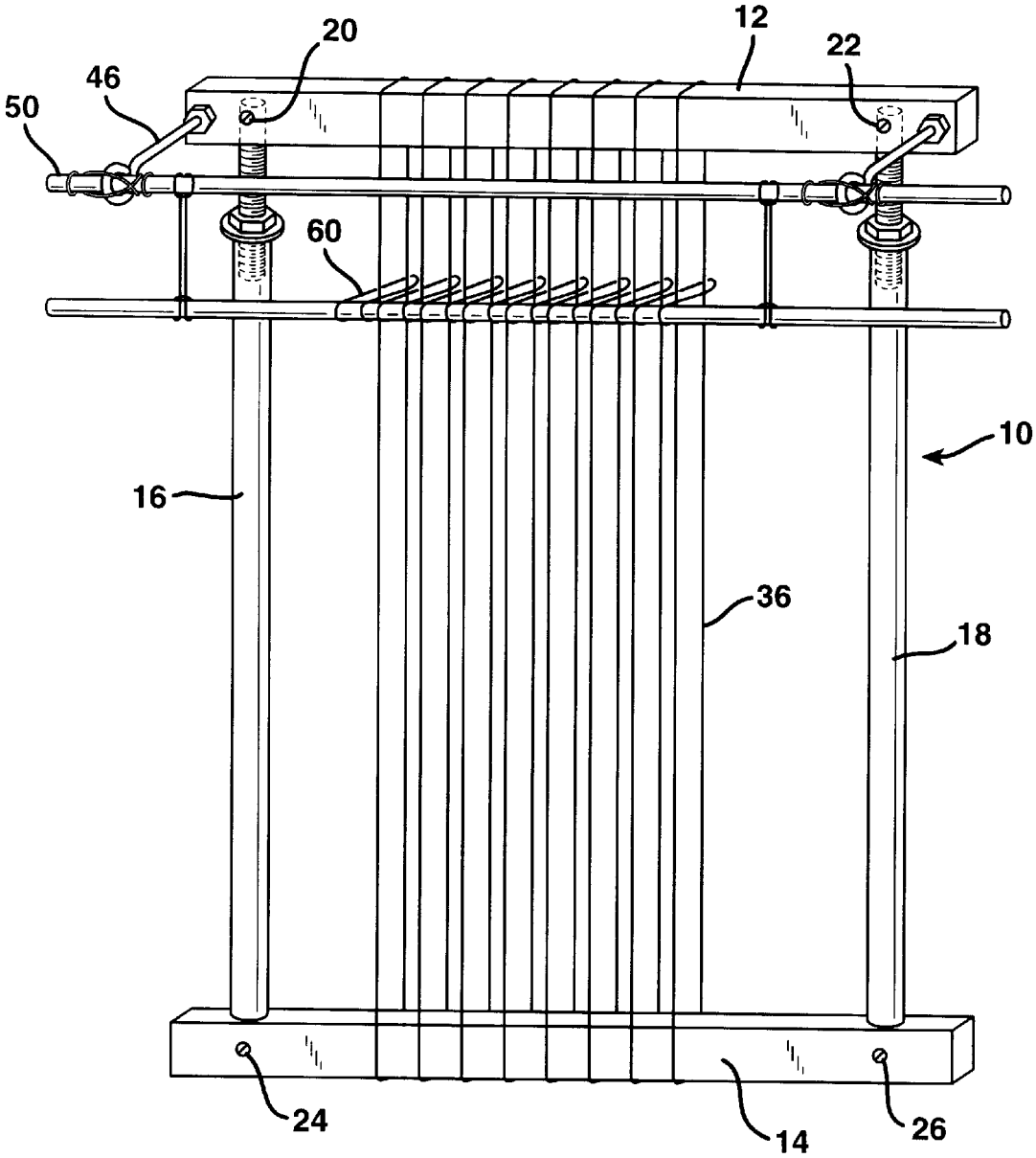
FIG. 1 is a perspective view of a portable loom of the present invention in assembled condition.

FIG. 1 illustrates the portable loom of the present invention in assembled condition; and the portable loom includes a quadrilateral frame member 10 formed by a header 12 and a spaced bottom frame member 14. Preferably, the header 12 and bottom frame member 14 are formed of a synthetic plastic material for strength and light weight.

The under surface of the header 12 and the upper surface of the bottom frame member 14 each have drilled openings adapted to receive the tubular side supports 16 and 18. Preferably, the side supports 16 and 18 are hollow tubes of a synthetic plastic material; and may be secured removably to the header and the bottom frame member 14 by known techniques. As illustrated, screws 20, 22, 24 and 26 may be inserted through side portions of the header 12 or bottom frame member 14 to be received in apertures in the side supports 16 and 18.

Figure 2:
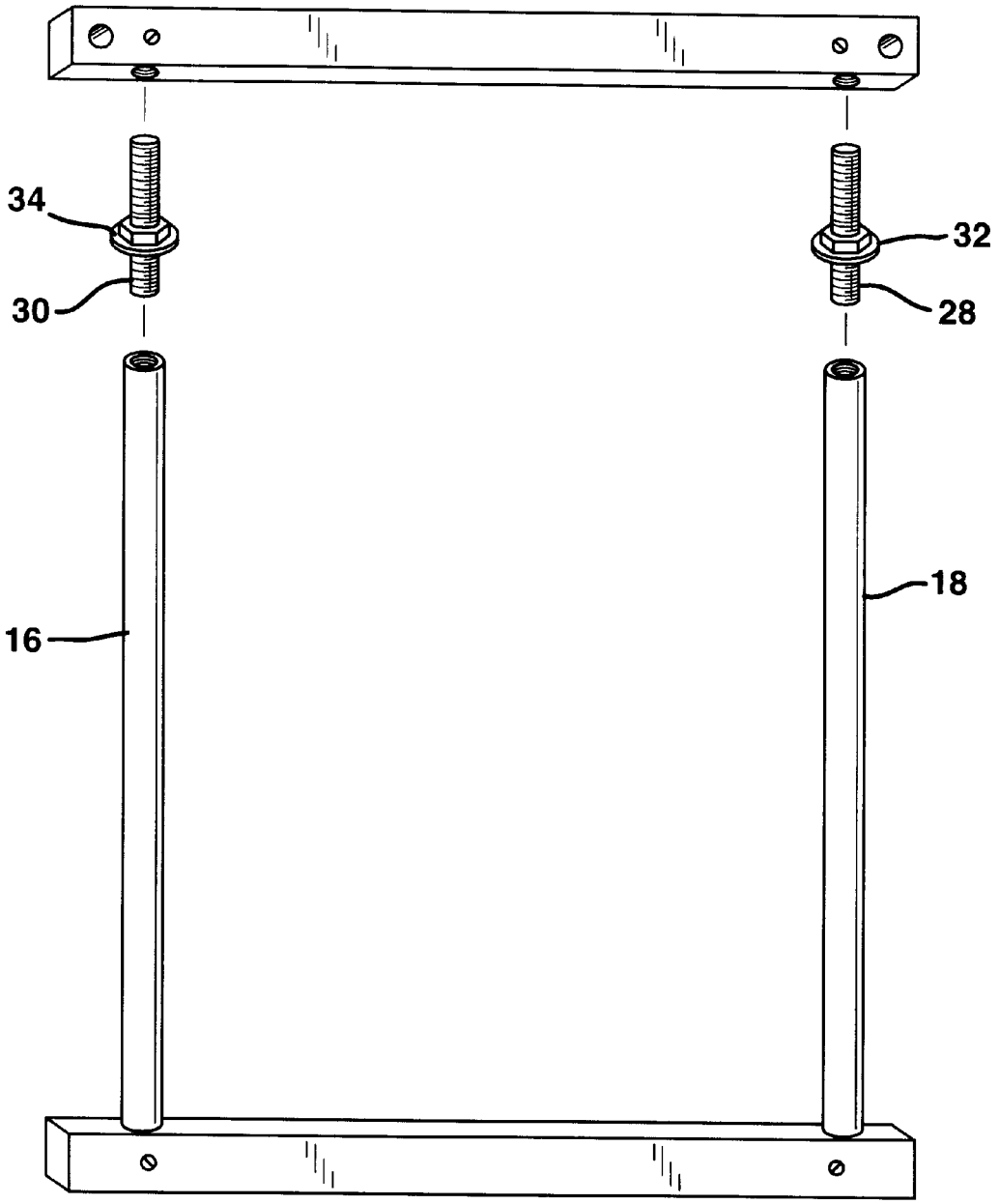
FIGS. 2 and 3 are perspective views illustrating the assembly of the tensioning structures associated with the side supports of the loom.
Figure 3:
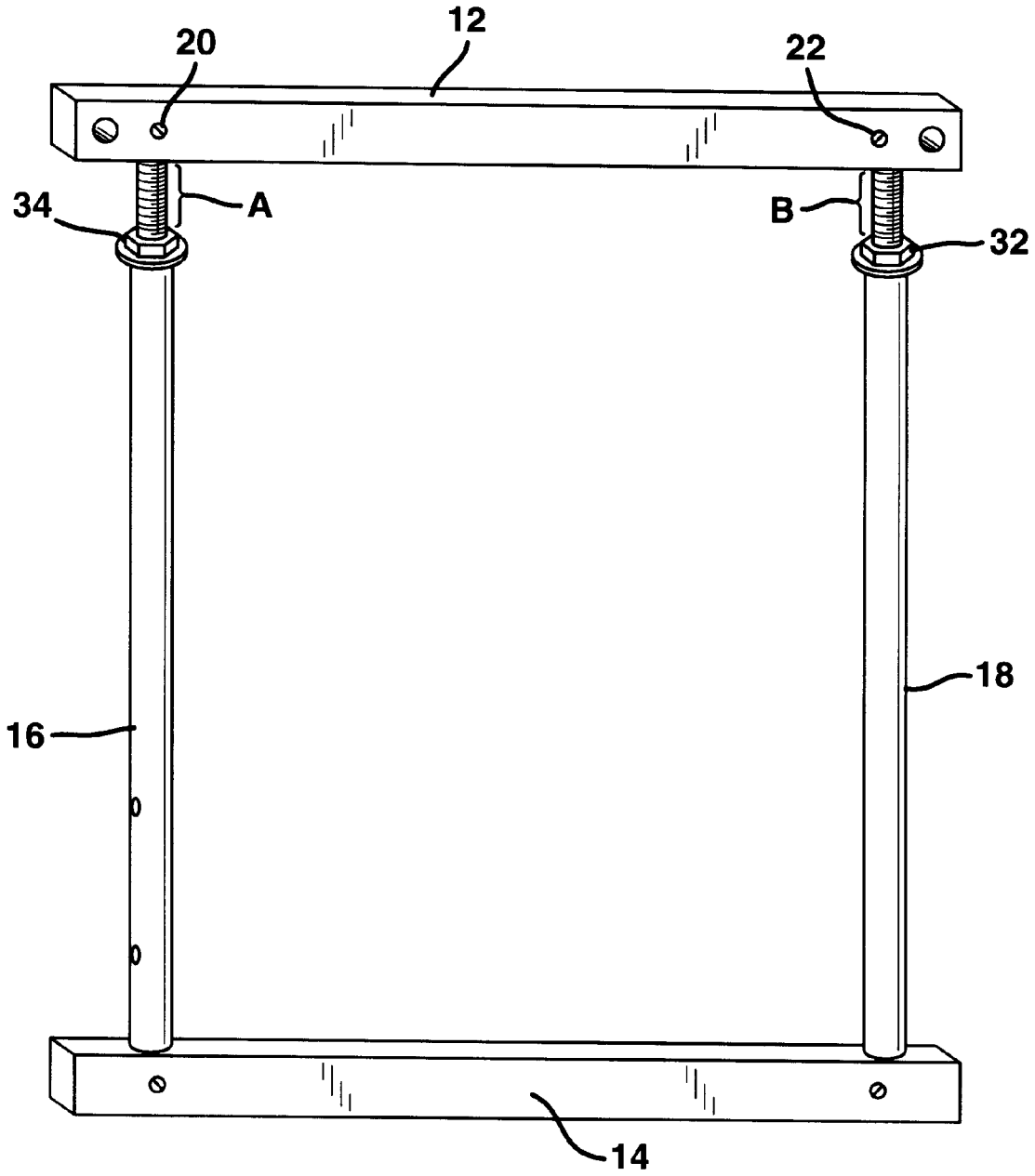

As illustrated in FIGS. 2 and 3, the side supports each include respective structures for adjusting the length of the side supports. Such structures are preferably formed by rods 28 and 30 which are externally-threaded and adapted to be received internally within the smooth base of the side supports 16 and 18. Each of the rods 28 and 30 has a respective abutment member 32 or 34 which is internally-threaded; and adapted to be seated upon the open end of the respective tubular side supports 16 and 18 as illustrated in FIG. 3. In this way, rotating the respective abutment members 32 and 34 can provide equal spacing as shown by the brackets A and B of FIG. 3. The length of the side supports and thus the tension of a warp 36 extending between the header 12 and the bottom frame member 14 can thus be adjusted. As understood, the upper portions of each of the externally-threaded rods 28 and 30 has a transverse aperture drilled therein so that the respective set screw 20 and 22 can be received for securing the side members to the header 12.

Figure 4:
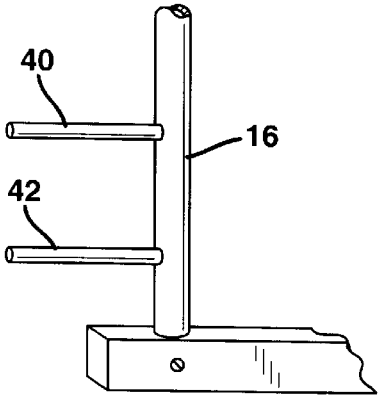
FIGS. 4 through 8 illustrate the production of the string heddles.
Figure 5:
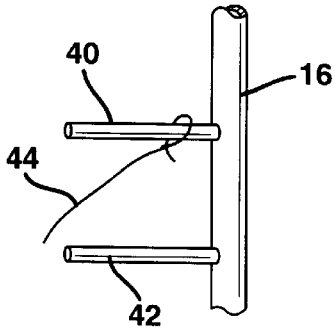
Figure 6:
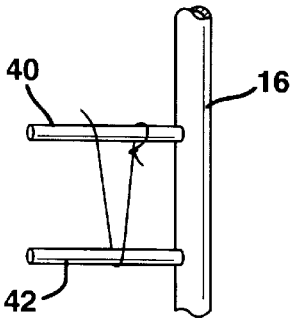
Figure 7:
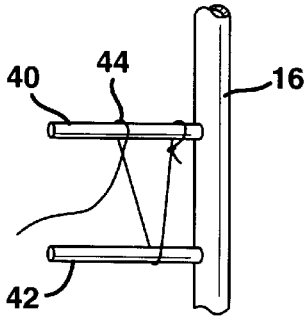
Figure 8:
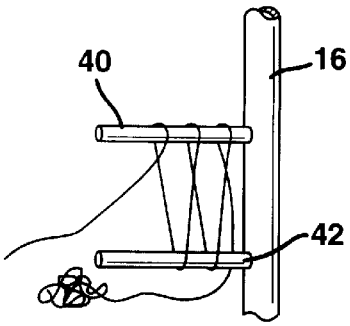

An important feature for the present invention is the ability to make string heddles rather simply. As illustrated in FIG. 4, one of the side supports has two apertures drilled therein at an appropriate space to removably receive dowels 40 and 42. As shown in FIG. 5, a loop end of a string 44 can be looped over the upper dowel 40 and then wound beneath the lower dowel 42 as illustrated in FIG. 6 to form a heddle. The string can then be knotted to form a loop 44 as illustrated in FIG. 7 so that subsequent heddles can be formed in the like matter as illustrated in FIG. 8. The number of string heddles to be created should equal half the number of warped threads. If there are an odd number of warp threads, then an additional heddle needs to be formed. In this way, the appropriate number of string heddles can be formed on location.

Figure 9:
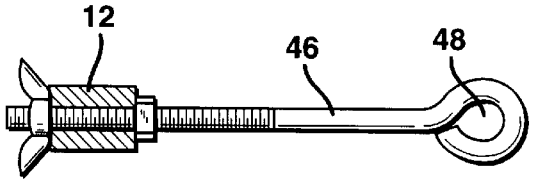
FIG. 9 illustrates the structures for supporting the stable heddle bar.
Figure 14:
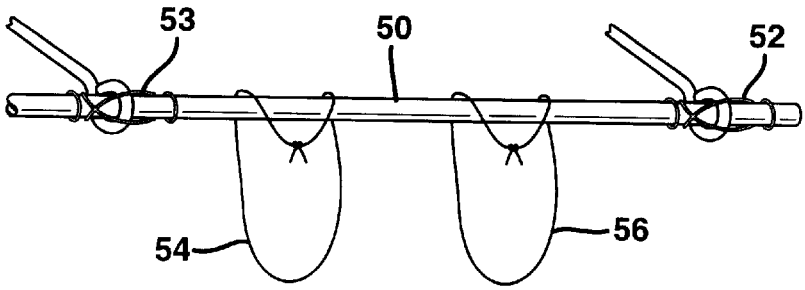
FIGS. 14 through 20 illustrate securing the pendant heddle bar.
Figure 15:
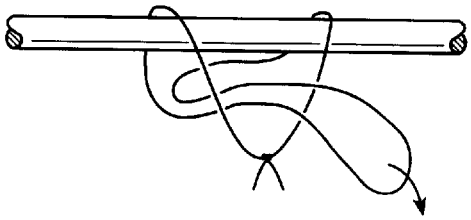
Figure 16:
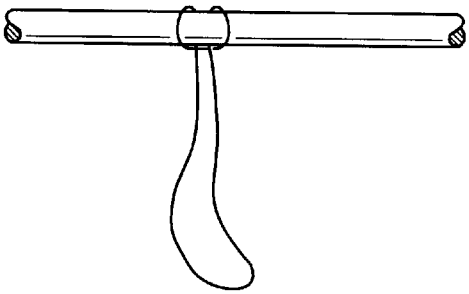
Figure 17:
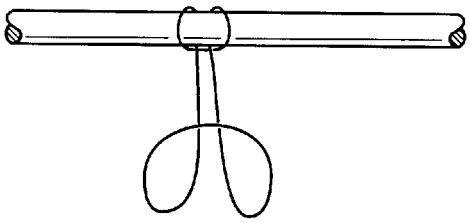
Figure 18:
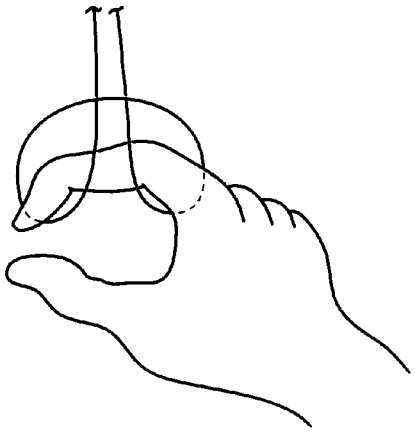
Figure 19:
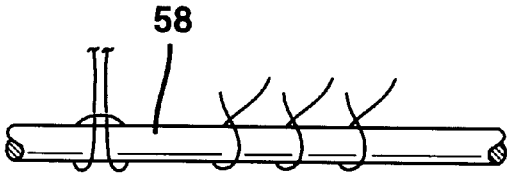
Figure 20:
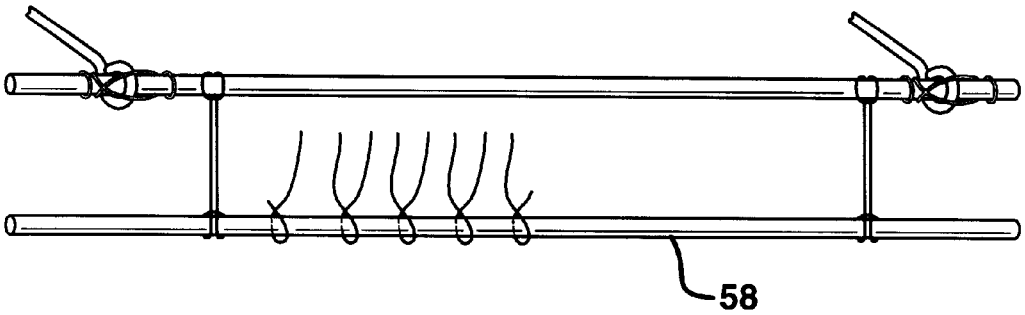

An eyebolt 46 is provided which can be received transversely within the header 12 as illustrated in section in FIG. 9. The dowel to serve as the stable heddle bar 50 can them be inserted through the eye 48 of the eyebolt, and can be held securely by, for example, rubber bands 52 and 53 as illustrated in FIG. 14 to assure the stable heddle bar will be held in position. As illustrated in FIGS. 14 through 18, strings formed into loops 54 and 56 are draped over the stable heddle bar and then secured as illustrated in FIGS. 15 and 16 to provide a depending loop. As illustrated in FIGS. 17 and 18 each loop can be turned upon itself to provide a loop adapted to receive a pendant heddle bar 58 as shown in FIGS. 19 and 20.

Figure 10:
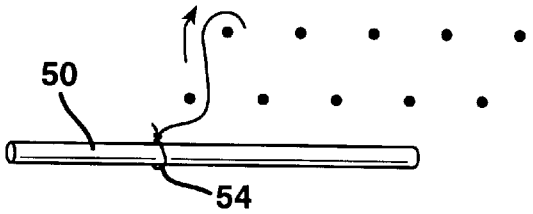
FIGS. 10 through 13 illustrate the use of the string heddles.
Figure 11:
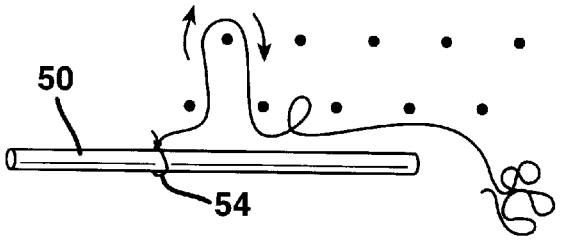
Figure 12:
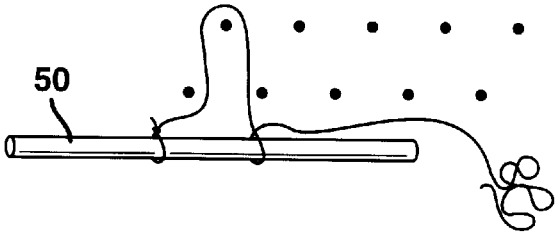
Figure 13:
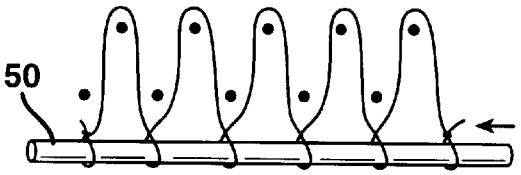

To attach the string heddles formed previously, the first loop of 58 of the first heddle is slipped over the pendant heddle bar 52 as shown in FIG. 10, and then the string heddles are inserted between the first two threads of the front shed of the warp to the first thread of the rear shed of the warp and wound back to the pendant heddle as shown in FIG. 12. Thereafter, as illustrated in FIG. 13, the string can be wound back and forth between the sheds of the warp to provide the heddle structure 60 illustrated in FIG. 1.

Figure 21:
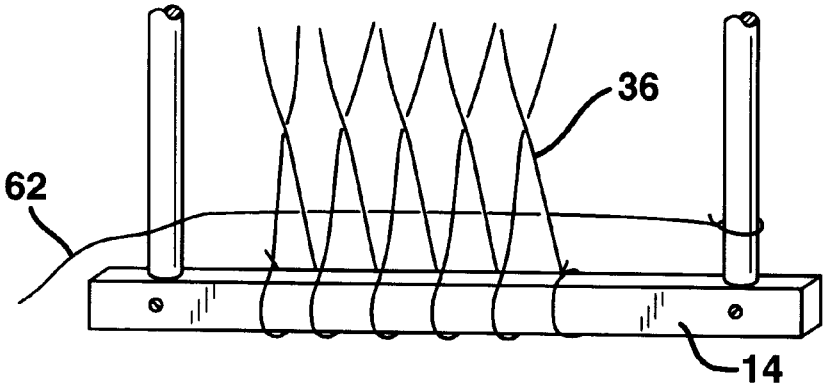
FIGS. 21 through 22 illustrate securing the warp spacing.
Figure 22:
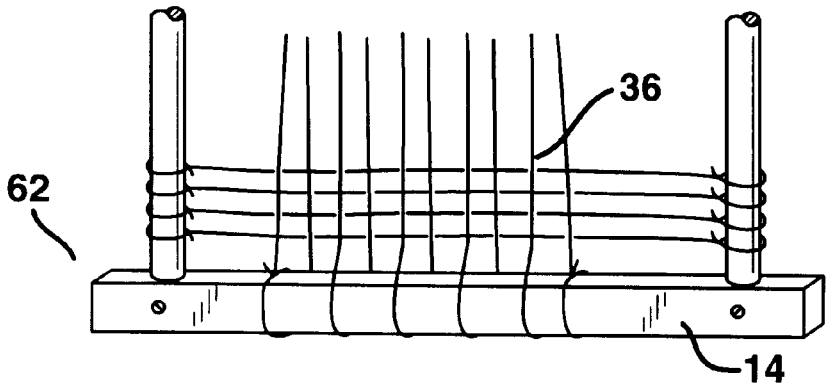

To secure the spacing of the warp 36, a heavy string 62 as illustrated in FIG. 21 is tied to a side support; and then it is threaded through the heddle shed as illustrated in FIG. 22. The string 62 can then be wrapped around the other side support and interwoven through the open shed as shown in FIG. 22 so that it will secure the spacing for the warp.

Figure 23:
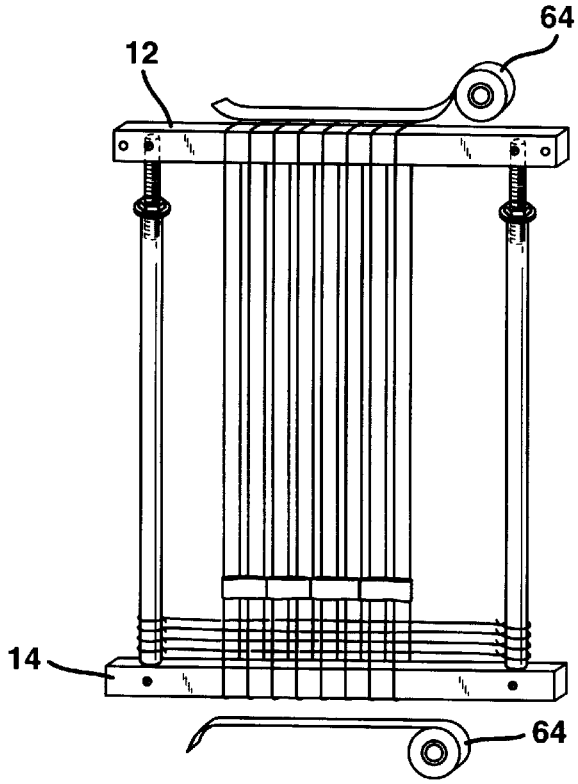
FIGS. 23 through 26 illustrate the manner of securing a tapestry or the like partially formed on the loom for transportation.
Figure 24:
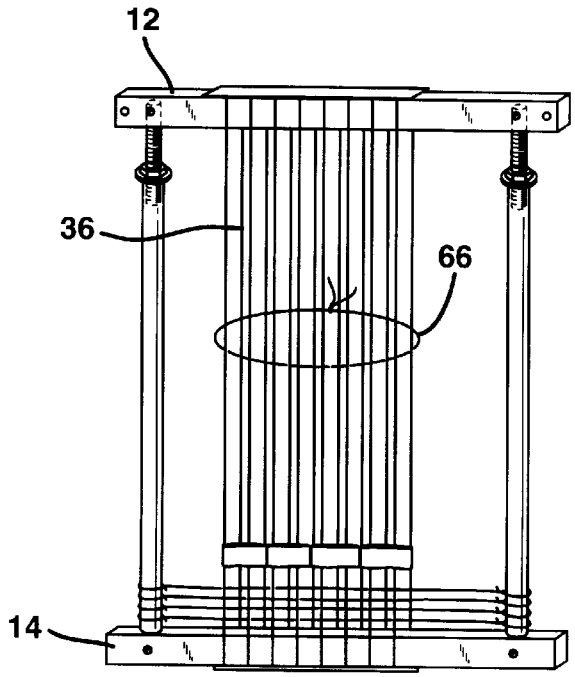
Figure 25:
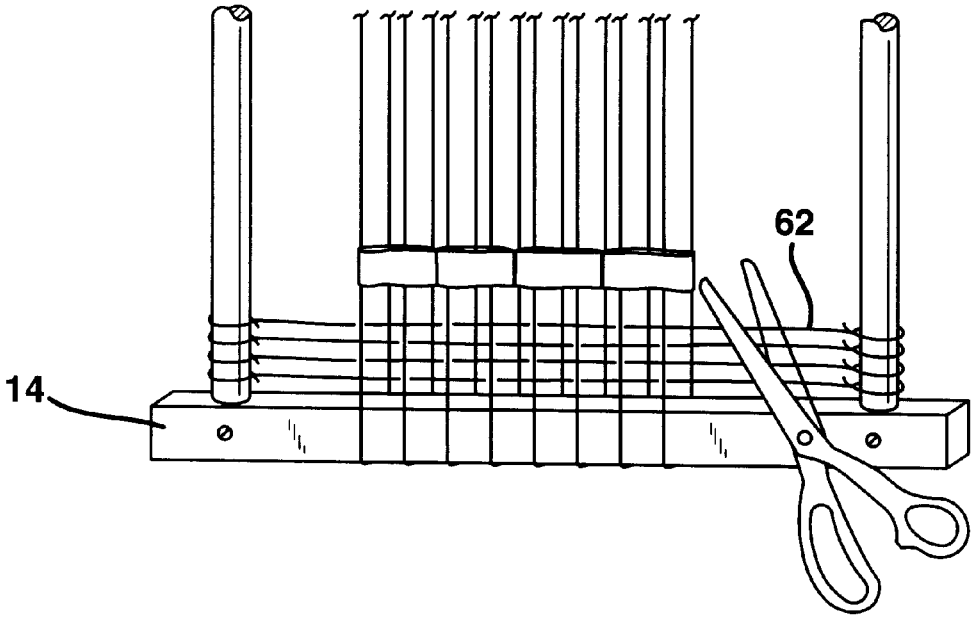
Figure 26:
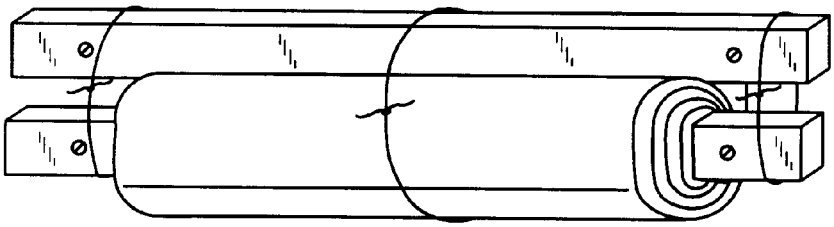

FIGS. 23 through 26 show the convenient manner in which a tapestry or the like partially completed on the loom can be secured. As illustrated in FIG. 23, tape 64 is utilized to secure the warp to the header 12 and bottom frame member 14; as illustrated in FIG. 3 a string 66 can be secured around the warp 36. Thereafter, the string 62 interlace between the bottom of the warp can be cut as shown in FIG. 25; and the side supports removed so that the bottom frame member 14 can be rolled upon the warp and then secured by string or the like to the header 12 as illustrated in FIG. 26.

The above descriptions of a preferred embodiment are not considered limiting to the scope of the invention; and the scope of my invention is set forth below in the appended claims.

I claim:

1. A portable loom comprising a header and a bottom frame member spaced in parallel relation thereto, and side supports extending removably between said header and said bottom frame member to form a quadrilateral frame, said side supports each including means for adjusting the length thereof to vary the tension of a warp extending between said header and said bottom frame member, said loom further comprising means for making string heddles; said heddle-making means including dowels each adapted to have one end received within respective apertures within said quadrilateral frame and extending to free ends to enable said string heddles to be formed there between.

2. A portable loom comprising a header and a bottom frame member spaced in parallel relation thereto, and side supports extending removably between said header and said bottom frame member to form a quadrilateral frame, said side supports each including means for adjusting the length thereof to vary the tension of a warp extending between said header and said bottom frame member, said loom further including means for making string heddles; said heddle-making means including dowels adapted to be received within apertures within said quadrilateral frame to enable said string heddles to be formed there between, said adjusting means each including an externally-threaded rod adapted to be inserted axially within a respective side support, and an internally-threaded abutment member adapted to seat upon one end of said respective side support.

3. A portable loom comprising a header and a bottom frame member spaced in parallel relation thereto, and side supports extending removably between said header and said bottom frame member to form a quadrilateral frame, said side supports each including means for adjusting the length thereof to vary the tension of a warp extending between said header and said bottom frame member, said loom further including means for making string heddles; said heddle-making means including dowels adapted to be received within apertures within said quadrilateral frame to enable string heddles to be formed there between, including a stable heddle bar held across an open area of such quadrilateral frame; and a pendant heddle bar depending from said stable heddle bar adapted to receive said string heddles.

* * * * *